US005139452A

United States Patent [19]

Coppola

[11] Patent Number: 5,139,452

[45] Date of Patent: Aug. 18, 1992

[54] METHOD AND APPARATUS FOR THE AUTOMATIC MEASUREMENT OF START TIME OF EVAPORATION OF BARIUM GETTER DEVICES

[75] Inventor: Antonio Coppola, Milan, Italy

[73] Assignee: SAES Getters SpA, Milan, Italy

[21] Appl. No.: 683,613

[22] Filed: Apr. 11, 1991

[30] Foreign Application Priority Data

Apr. 11, 1990 [IT] Italy ..... 19988 A/90

[51] Int. Cl.[5] ..... H01J 9/42

[52] U.S. Cl. ..... 445/63

[58] Field of Search ..... 445/3, 6, 55, 63

[56] References Cited

U.S. PATENT DOCUMENTS 4,668,203 5/1987 Giudici ..... 445/55
4,820,223 4/1989 Benigni et al. ..... 445/3
4,881,914 11/1989 Kamp et al. ..... 445/73

FOREIGN PATENT DOCUMENTS 143546 7/1985 Japan ..... 445/3

*Primary Examiner*—Kenneth J. Ramsey

*Attorney, Agent, or Firm*—David R. Murphy

[57] ABSTRACT

A method is described for the automatic determination of the time when barium starts to evaporate, or "start time", of barium evaporable getters. A temperature difference measurement is made of the temperature of the glass wall outside the getter location by means of a sensor preferably comprising an infrared pyrometer calibrated on a wave length of about 10 μm suitable for measuring temperatures of 0°-500° C. Under these conditions the temperature curve measured, through an integral function, follows the behavior of the temperature of the getter which reveals a typical behavior at the moment in which barium starts to evaporate. Once ΔT has been calculated from the analysis of a series of experimental test results on the integral curve, that value corresponds to the start time. The measurement of temperature is transformed into a suitably amplified voltage this giving a value of V corresponding to the start time. This can then be used to automatically regulate the R.F. generator power level to obtain a constant start time or to regulate the total time of evaporation of the getter so as to obtain a constant barium yield.

6 Claims, 2 Drawing Sheets

100
105
102
104
d
106
108
110
112
114

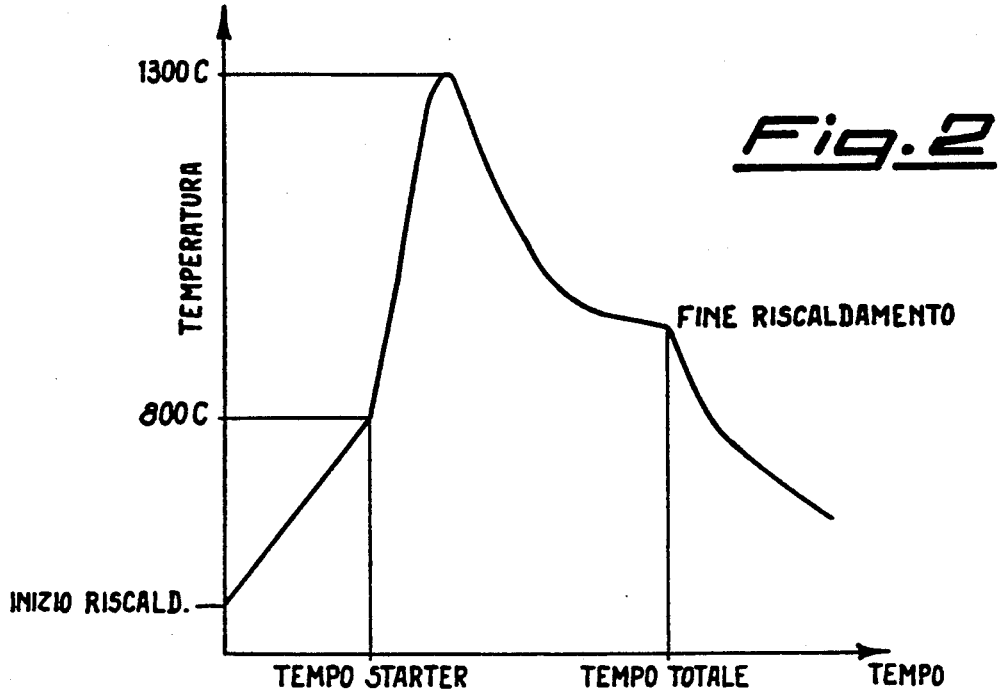
Fig. 2
Fig. 3
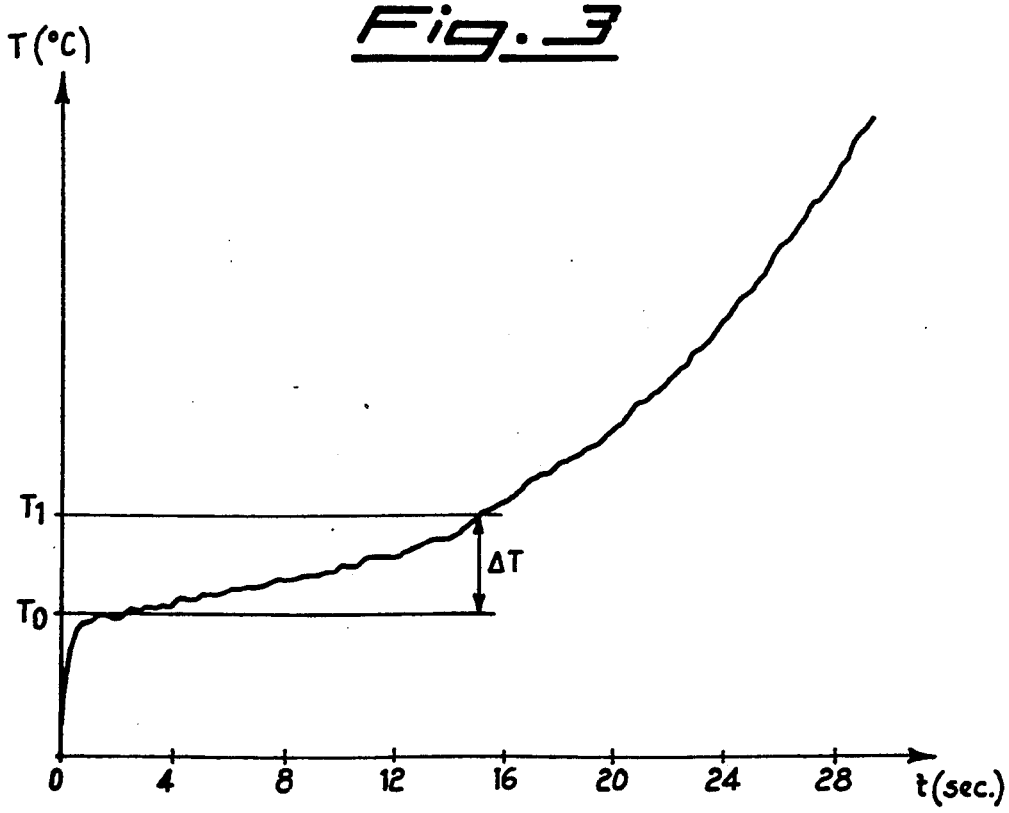

METHOD AND APPARATUS FOR THE AUTOMATIC MEASUREMENT OF START TIME OF EVAPORATION OF BARIUM GETTER DEVICES

BACKGROUND

The present invention relates to a method and device for the automatic measurement of the evaporation time of a barium getter.

It is known that evaporable getter devices that are mounted within an evacuated electron tube, generally near to the glass wall, have to be evaporated before use. The evaporation takes place when, generally, the tube has been evacuated and tippedoff. Evaporation of the evaporable getter device takes place by heating the device to a temperature such that the barium contained therein is freed, in the form of vapours, which then deposits in the form of a thin film on surfaces within the tube.

It is also well known that this heating generally takes place by induction heating at high frequency by at least one R.F. coil positioned outside the glass wall at as small a distance as possible from the getter device. U.S. Pat. No. 4,302,063 and European Patent Application No. 0,321,042 describe methods, and relative apparatus, suitable for improving electromagnetic coupling between the coil and getter device and to determine the optimum position of the coil. In this way uncertainties in coil positioning relative to the getter are minimized thus obtaining minimum energy dispersion and maximum heat transfer to the getter device.

Using the apparatus described in the above noted publications it is possible to make this step of production of the vacuum tube automatic with subsequent reductions in cost and increased output, especially in cases of mass production as for example in the field of colour television picture tube.

However, it has not been possible, up to now, to take advantage of all the benefits offered by automating these operations because of the difficulties met with in determining the so called "start time" of evaporation of each individual getter device. By the term "start time" or time when barium starts to evaporate there is meant the time interval in seconds between the application of heating power and the onset of barium evaporation when there is the start of "flashing" due to onset of the exothermic reaction which is responsible for barium evaporation. The importance of knowing the start time is due to the fact that normally, as the total time of application of RF power to the coils is fixed, then a variation in start time to greater or lesser values than those recommended by the getter manufacturer can lead to, respectively a reduction in the barium yield or an overheating of the getter holder which may even melt. The disadvantages which can occur in the latter case are obvious but even in the former an insufficient yield of barium within the vacuum tube can result in a reduced life. With this in mind the getter manufacturer provides the user with graphs which show the getter "yield curves" which indicate, for various total times of R.F. generator functioning, the mass of barium evaporated as a function of start time or start of evaporation.

Hence it is important to measure, each time, the value of the start time which, up to now, has been measured by simple direct visual observation by an operator who is usually the person in charge of the R.F. generator. However, direct observation of the start time is extremely difficult, if not impossible, apart from, inevitable human errors, due to the fact that normally the kinescope glass is internally covered with an opaque layer based on graphite which is known as "Dag" by those skilled in the art. Even when a small "window" is left in the dag layer, corresponding to the getter position, the getter container, especially if using a ceramic support does not permit an adequate view within the tube.

BRIEF OBJECTS OF THE INVENTION

It is therefore an object of the present invention to provide an improved method and apparatus for the automatic measurement of the start time or start of evaporation of a barium getter device mounted within a vacuum tube and evaporated by induction heating by means of a coil supplied with R.F. and suitably positioned, in a known way with respect to the getter device, outside the wall of the vacuum tube.

The method according to the present invention is based on the measurement of the temperature on the external face of the wall of the vacuum tube corresponding to, and coaxial with, said induction heating coil by means of an infra-red pyrometer working at a wavelength of about 10 μm capable of measuring temperatures in an interval from 0° C. to 500° C. From these measurements a temperature curve is obtained which reflects the trend of the getter temperature. The start of flashing corresponds to a temperature increase, $\Delta T$, which results from many experimental observations. The temperature difference is made to correspond to a voltage value which can be used to make a real time automatic control of the R.F. generator feeding the induction coil; both the power level and the total time of the heating process can be controlled.

Another object of the present invention is to provide an apparatus capable of carrying out the method described above in an automatic manner at a relatively low cost.

Further objects and advantages of the present invention will become apparent with reference to the detailed description thereof and drawings wherein:

BRIEF DESCRIPTION OF THE DRAWINGS

FIG. 2 is a graph showing the temperature behaviour of an evaporable barium getter device as a function of time; and FIG. 3 shows the measured temperature behaviour of the outer wall of a vacuum tube measured by an apparatus of the present invention.

DESCRIPTION OF THE INVENTION

Figure 1:
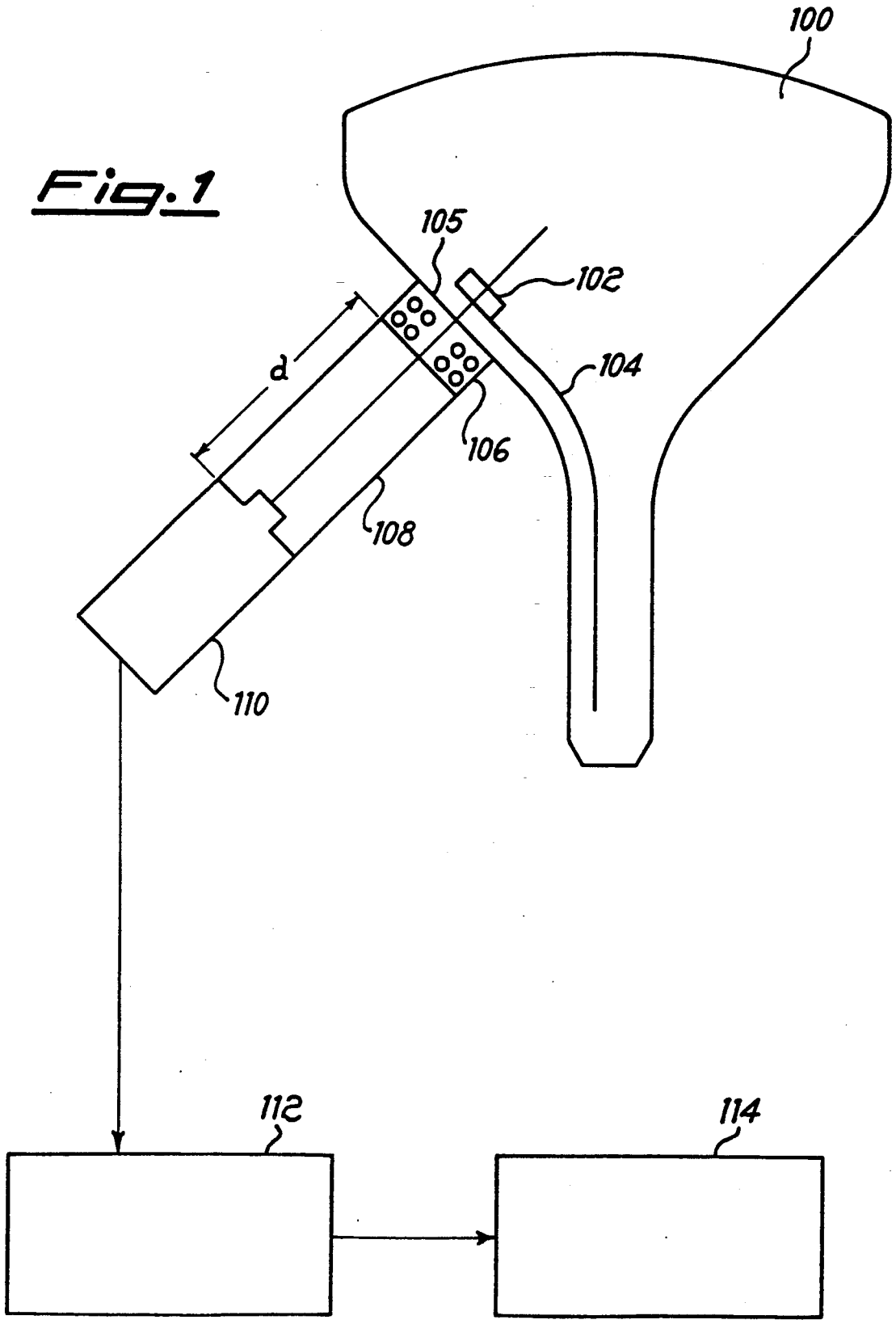
FIG. 1 shows a diagram useful in describing the method of the present invention when applied to a colour television picture tube.

With reference to FIG. 1 there is shown a diagrammatic representation of a colour television kinescope 100 containing an evaporable barium getter device 102, mounted on an antenna spring 104 near to glass wall 105 of kinescope 100 and within its cone portion. Getter device 102 may be provided with a ceramic support which behaves as a separator between the container of getter device 102 and wall 105 of kinescope 100. Externally to wall 105 and coaxially with getter device 102 there is placed an induction heating coil 106 for heating the getter material as is known in the art.

According to the present invention the temperature on the outside of wall 105 is measured by means of a probe 108 of a sensor 110 which is preferably an infra-red pyrometer working at a wavelength suitable for measuring temperatures between 0° C. and 500° C. which include those measured on the outside glass wall corresponding to the position of the getter device. It is preferred to use an infra-red wave length as far away as possible from the visible spectrum such as 10 μm. In sensor 110 the temperature increase or ΔT measured is transformed into a ΔV. Then ΔV can be fed to the input of an amplifier 112 to pilot a control logic circuit 114 which can directly control the power supplied to coil 106, so closing (not shown) a feedback circuit through which it is possible to regulate, in real time, the barium evaporation from getter device 102.

FIG. 2 shows the behaviour of temperature with time measured on a getter device heated by induction coil 106. It is seen that there is an initial continuous increase in temperature up to a value of about 800° C. whereupon an exothermic reaction starts within the getter material resulting in a sudden increase in temperature and so a discontinuity of the curve. The reaction causes evaporation of barium according to:

$$BaAl_4 + 4Ni \rightarrow Ba + 4NiAl$$

where $BaAl_4$ is a known alloy commonly used in barium getters as a powder, in mixture with nickel powder, in compressed form. The time corresponding to the temperature increase is the "start time" which normally varies from about 8 seconds to 15 seconds which is equal to the delay between the start of induction to the start of barium evaporation. The total time of application of the induction heating, indicated in FIG. 2, has a duration of about 30–40 seconds and corresponds to a point of now decreasing temperature. The importance has been shown of knowing the start time in order to ensure a good barium yield by suitably varying, for example, the total time of evaporation of the induction coil, or increasing the power applied but avoiding melting of the container due to too short a start time which can be overcome by shortening the total heating time or reducing the R.F. power.

Given the difficulties encountered in a direct measurement of the start time, its value is calculated by taking a difference measurement of the temperature of the glass wall which substantially corresponds to an integrated temperature measurement of the getter due to the components included between getter device 102 on the point of measurement on the glass wall 105. These components include the vacuum, the getter support, any "Dag" coating and the glass wall.

In effect the graph represented in FIG. 3, which shows the temperature measured by device 108, 110 on the external portion of glass wall 105, is substantially the integral of the curve shown in FIG. 2. It is seen that the initial temperature, $T_o$, of the kinescope indicated in FIG. 3 is higher than that of the getter in FIG. 2 which is normal due to the preliminary kinescope degassing treatment and sealing. However the initial temperature, $T_o$, has no effect on the determination of the start time in as much as an absolute value of temperature is not considered but rather a temperature difference, $\Delta T = T_i - T_o$. the time corresponding to temperature $T_i$ determines the start time or time of start of barium evaporation. The value of ΔT is calculated form previous laboratory experiments by analyzing a series of curves made using kinescopes provided with a window in the "Dag". The value of ΔT depends, naturally, on the thickness and type of glass employed, on the thickness of the "Dag" as well as on the type of getter support (the presence or otherwise of ceramic) and remains constant for an extremely large number of kinescopes in mass production. Of course the working conditions must be maintained reasonably constant for example the probe 108 must remain perfectly coaxial with getter device 102 and with coil 106, the sensor 110 is maintained at a distance of 30 cm from coil 106 and the temperature of the external surface of the kinescope is less than 70° C.

Although the invention has been described in considerable detail with reference to certain preferred embodiments designed to teach those skilled in the art how best to practice the invention, it will be realized that other modifications may be employed without departing from the spirit and scope of the appended claims.

What is claimed is:

1. A device for the automatic measurement of the start time of barium evaporable getter devices in which the getter device (102) is mounted inside a vacuum tube (100) near to a certain zone (105) of its glass surface in correspondence with which is externally placed at least one heat induction coil (106) for heating the getter, comprising:

a temperature sensor (108, 110) responsive to the surface temperature of said outer wall (105); and means for tracing a curve of the behavior of said temperature and, corresponding to a different value (delta T) either predefined or calculated by differentiation; and means for reading the start time from said curve.

2. A device according to claim 1 further comprising means for transforming said value (delta T) by the same sensor (110) to a potential difference (delta V); and means for employing delta T as the input of an amplifier (112) including a programmed logic circuit (114) which can drive the radio-frequency input of said coil (106) to vary the total time of evaporation or the power level applied.

3. A device according to claim 1 characterized by the fact that said sensor device is an infra-red pyrometer (110) with a probe (106) coaxial with said coil (106).

4. A device according to claim 3 characterized by the fact that said infra-red pyrometer (110) works at a wave length of about 10 μm and measures the external wall (105) temperature, facing the getter, between 0° C. and 500° C.

5. A device according to claim 3 characterized by the fact that said sensor (110) is placed at a distance (d) of about 30 cm from said coil (106) and is coaxial with it and the getter device (102).

6. A device according to claim 5 in which the temperature on the external surface of the wall (105) of the vacuum tube is less than 70° C.

* * * * *